US009656402B2

(12) United States Patent
Roth et al.

(10) Patent No.: US 9,656,402 B2
(45) Date of Patent: May 23, 2017

(54) GRIP-TYPE CUTTER KNIFE

(75) Inventors: Harald Roth, Kordel (DE); Beate Lube, Trier (DE); Norbert Weber, Pluwig (DE); Erich Wick, Thomm (DE)

(73) Assignee: JT International S.A., Geneva (CH)

( * ) Notice: Subject to any disclaimer, the term of this patent is extended or adjusted under 35 U.S.C. 154(b) by 120 days.

(21) Appl. No.: 14/123,224

(22) PCT Filed: May 18, 2012

(86) PCT No.: PCT/EP2012/059296
§ 371 (c)(1),
(2), (4) Date: Jan. 31, 2014

(87) PCT Pub. No.: WO2012/163703
PCT Pub. Date: Dec. 6, 2012

(65) Prior Publication Data

US 2014/0144027 A1 May 29, 2014

(30) Foreign Application Priority Data

Jun. 1, 2011 (EP) ..... 11168415

(51) Int. Cl.
*B26B 25/00* (2006.01)
*B26B 29/02* (2006.01)

(52) U.S. Cl.
CPC ..... *B26B 25/005* (2013.01); *B26B 29/02* (2013.01)

(58) Field of Classification Search
CPC ..... B26B 25/00; B26B 25/002; B26B 25/005; B26B 25/007; B26B 5/005; B26B 3/06; B26B 27/005; B26B 29/00; B26B 29/02
(Continued)

(56) References Cited

U.S. PATENT DOCUMENTS 3,590,483 A * 7/1971 Szczepanski ..... B26B 5/00 30/151
4,020,550 A * 5/1977 Okada ..... 30/124
(Continued)

FOREIGN PATENT DOCUMENTS

DE 200 21 142 U1 4/2001
DE 20 2005 012 460 U1 11/2005
(Continued)

OTHER PUBLICATIONS

The definition of "consistently" accessed at http://www.dictionary.com/consistently on Sep. 27, 2016.*
(Continued)

*Primary Examiner* — Kenneth E. Peterson
*Assistant Examiner* — Evan MacFarlane
(74) *Attorney, Agent, or Firm* — Norton Rose Fulbright US LLP

(57) ABSTRACT

A cutter knife body having a grip portion, the grip portion including a trigger lever, a cutting blade provided on an end of the cutter knife body, a pin rotatably supporting the cutting blade in the cutter knife body, a locking member placed in an opening formed in the cutter knife body, and a pair of cutting blade protector flanges, each protector flange being disposed on a side of the cutting blade, each cutting blade protector flanges having an outward protrusion from a surface of the flange, the grip type cutter knife including a pair of springs located between the pin and each of the outward protrusion from the flange surface, the pair of flanges being slidably supported in the cutter knife body by the pin and the pair of springs.

15 Claims, 6 Drawing Sheets

(58) Field of Classification Search
USPC ..... 30/2, 162, 163, 292, 306, 307, 319, 390, 30/391
See application file for complete search history.

(56) References Cited

U.S. PATENT DOCUMENTS 4,247,148 A * 1/1981 Eriksson ..... 299/40.1
4,545,121 A * 10/1985 Armbruster et al. ..... 30/374
5,101,564 A * 4/1992 Melter ..... B26B 5/003 30/292
5,241,750 A * 9/1993 Chomiak ..... 30/2
5,305,729 A * 4/1994 Chiuminatta et al. ..... 125/12
5,697,157 A * 12/1997 Votolato ..... 30/2
5,765,289 A * 6/1998 Schulz ..... B26B 25/005 30/292
6,070,326 A * 6/2000 Berns ..... B26B 29/02 30/2
2007/0028463 A1* 2/2007 Chan ..... B26D 1/205 30/319

FOREIGN PATENT DOCUMENTS

JP 52-12394 A 1/1977
JP 54-129695 U 2/1978
JP 2000-000381 A 1/2000

OTHER PUBLICATIONS

The definition of "flat" accessed at http://www.dictionary.com/browse/flat?s=t on Sep. 27, 2016.*
Translation of Office Action dated Jan. 26, 2015 in corresponding application JP 2014-513115 (3 pgs.).
Office Action dated Feb. 12, 2015 in corresponding application CA 2,837,783 (3 pgs.).

* cited by examiner

GRIP-TYPE CUTTER KNIFE

CROSS REFERENCE TO RELATED APPLICATIONS

This application claims benefit from and priority to International Patent Application No. PCT/EP2012/059296, filed May 18, 2012, and of the European Patent Application No. 11 168 415.5, filed Jun. 1, 2011, the entire disclosures of which are incorporated herein by way of reference.

TECHNICAL HELD

The present invention relates to a grip-type cutter knife, and especially to a grip-type cutter knife that allows a user improved safety operation.

TECHNICAL BACKGROUND

One known example of a conventional grip-type cutter knife is illustrated in FIGS. 1 and 2. The conventional grip-cutter knife 10 comprises an elongated cutter body 11 provided with a grip portion 12. At the front end of the body 11, a circular rotary blade 15 is provided. As illustrated in FIG. 1, the rotary blade 15 is projected from the body for cutting. As illustrated in FIG. 2, the rotary blade 15 is retracted in the body, and cutting is not possible.

The rotary blade 15 is connected to a swing member which is pivotably supported in the cuter body 11. A part of this swing member is projected from the grip portion 12 to serve as a trigger lever 14, as illustrated in FIG. 2. The swing member is forced into the non-cutting position by a spring member arranged in the cutter body 11. When grasping the trigger lever 14 into the cutter body 11 against the force exerted by the spring, the rotary blade 15 is projected from the forward end of the cutter body 11. When releasing the grasping hand, the rotary blade 15 is retracted into a platform 13 at the forward end of the cutter body.

FIGS. 3 to 5 are perspective views showing another example of a conventionally known cutter knife that in addition to having all the elements described above in connection with the knifes of FIGS. 1 and 2, is provided as well with a push-lock button 30.

The lock button 30 may be constituted by a cylindrical locking member. The height, or length, of the lock button is equal to the sum of the cutter body thickness and the thickness of an upward projection of the lock button. When the lock button 30 is pushed into the cutter body 21 the lock button is downwardly projected from the backside of the cutter body 21. When the lock button 30 is upwardly projected, as illustrated in FIG. 3, the swing of the swing member 44 is blocked so that the rotary blade 55 cannot descend.

When the lock button 30 is pushed into the cutter body so as to project downwardly, the rotary blade 55 can freely move when grasping or releasing a grip portion.

It is conventionally known that a cutter knife comprises two body pieces and a swing member sandwiched in between the body pieces. The two body pieces constitute the cutter body, and in the knife configurations known in the art, the swing member caries the rotary blade 55, and one end of the swing member serves as a trigger lever 44.

A body piece has a configuration corresponding to that of a cutter body 21. The body piece is at its front end provided with a platform 230, as illustrated in FIG. 5, which accommodates the rotary blade 55. At the center of the platform 230, an elongated circular opening 231 is formed for allowing the rotary blade to slide. At the opposite side of the platform 230 an elongated grip portion is arranged. Between the platform 230 and a grip portion 210 a circular opening 220 is formed for holding the cylindrical locking member 30 in the thickness direction of the cutter body 21.

As it may be observed in connection with the configurations of the cutting knife shown in FIGS. 1 to 5, irrespective that the blade is in a lowered position or in a retracted position, the blade is exposed at all times. Thus injury may easily occur as a result of incorrect handling of the cutter knife. Further, while in operation, for cutting materials that tend to slip on the cutting surface, where the operator might need to secure with its hands in position the material to be cut, the risk of injury to the hands of the operator is increased since no protective surface prevents the hands of the operator from touching the blade. Further yet, since in the configurations known in the art the blade is exposed at all times, the blade edge may be easily damaged, e.g. by denting.

SUMMARY OF THE INVENTION

It is therefore one idea of the present invention to provide a knife that exhibits increased safety for the operator. Further, the present invention aims to provide a knife where the blade is protected at all times without increasing the complexity of the knife's configuration.

The present invention proposes a grip type cutter knife, comprising a cutter knife body having a grip portion, wherein the grip portion comprises a trigger lever, a cutting blade provided on an end of the cutter knife body, a pin pivotably supporting the cutting blade in the cutter knife body, a locking member placed in an opening formed in the cutter knife body, and a pair of cutting blade protector flanges, each protector flange being disposed on a side of the cutting blade, wherein each cutting blade protector flange has an outward protrusion from a surface of the flange. The grip type cutter knife is characterized by further comprising a pair of springs located between the pin and the outward protrusion from the flange surface, wherein the pair of flanges is slidably supported in the cutter knife body by the pin and the pair of springs.

The configuration proposed by the present invention provides for protection to the cutting blade by protecting the blade at all times from both sides. As such, the blade is not exposed and no denting of the blade will involuntarily occur.

The grip type cutter knife of the present invention comprises a pair of flanges that each has a flat bottomed shape.

As it will be explained in detail latter in this document, the particular shape of the cutting blade protector flanges intervenes in all instances between the blade and an obstacle that may be encountered between the cutting blade protector flanges and the cutting blade. Should the obstacle be for example the finger of the operator, the protruding square edge of the cutting blade protector flange will come first in contact with the finger of the operator, prior to the blade coming in contact with the finger of the operator. As such, the grip type cutter knife of the present invention provides for safe operation of such a grip type cutter knife.

The present invention proposes a grip type cutter knife having a pair of springs located between the pin and the outward protrusion from the flange surface, wherein the pair of flanges is slidably supported in the cutter knife body by the pin and the pair of springs. As a result, when an operator impinges the knife upon the material to be cut, the flanges are as well impinged. When the flanges come in contact with the material to be cut, the springs contract and respond with an opposing force to the force exerted upon the knife by the operator. As a result, the blade of the knife may be brought in contact with the material to be cut without exposing the blade, since the flanges continue to impinge on the surface of the material to be cut and will be raised by the force exerted by the springs from the surface of the material only enough to free the blade but not enough to compromise their protective function described above insofar the fingers of the operator.

Further advantages of the present invention may be identified in connection with the features recited by the dependent claims, and will be described further in this document in connection with particular features of the present invention.

The cutter knife body of the grip type cutter knife of the present invention comprises a platform, the cutting blade and the pair of cutting blade protector flanges being disposed on the platform. The platform comprises an elongated circular opening for allowing the cutting blade and the cutting blade protector flanges to slide outwards from the cutter knife body.

Each cutting blade protector flange comprised by the grip type cutter knife of the present invention has an outward protrusion from a surface of the flange and each outward protrusion supports a first extremity of each of pair of springs. A second extremity of each spring impinges upon the pin.

The cutter knife body of the grip type cutter knife of the present invention has a guiding cavity with an opening towards the platform, each of cutting blade protector flange has a guiding pin extending out in the cavity, and each of the guiding pins of the cutting blade protector flanges is capable of translational movement within the guiding cavity.

The grip type cutter knife of the present invention further comprises a closing plate having a sliding channel, and a first extremity of the pin is capable of executing a translational sliding motion in the sliding channel. The grip type cutter knife of the present invention also further comprises dip and washer assembly that are secured to the grip knife at a second extremity of the pin.

The circumference of the cutting blade is smaller than the circumference of each cutting blade protector flange, and the shape of each flange is circular, with a flat bottom portion in the vicinity of the flange that comes into contact with a material to be cut, and a flat vertical portion in a portion of the flange extending away from the flat bottom portion, the flat bottom portion and the flat vertical portion of the flange forming a 90 degrees angle.

BRIEF DESCRIPTION OF THE DRAWINGS

Embodiments and modifications of the present invention will now be described with reference to the accompanying drawings, in which, as mentioned above.

Figure 1:
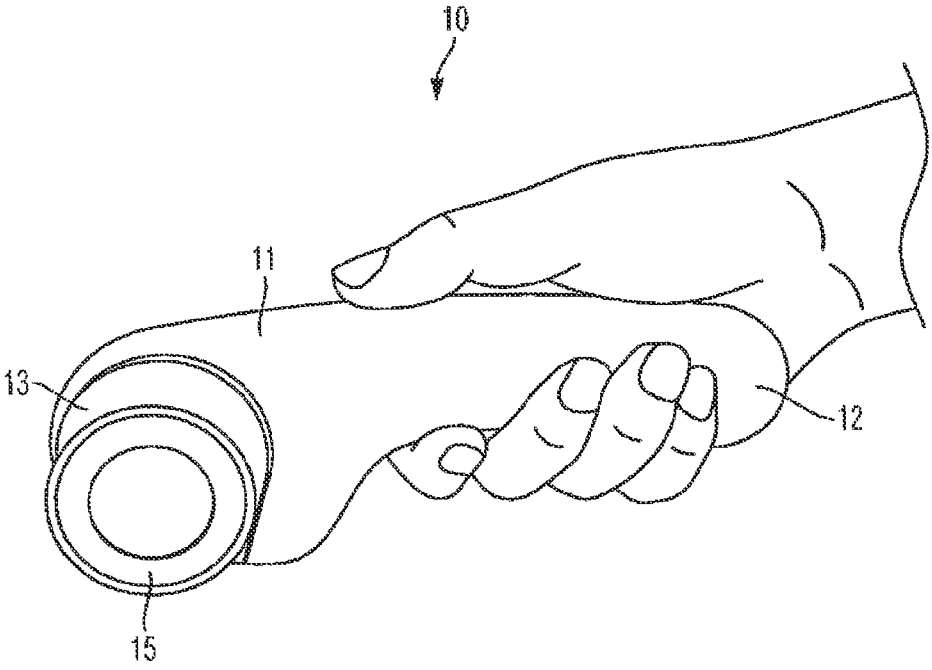
Fig. 1 PRIOR ART
FIGS. 1 and 2 represent a conventional grip-type cutter knife.
Figure 2:
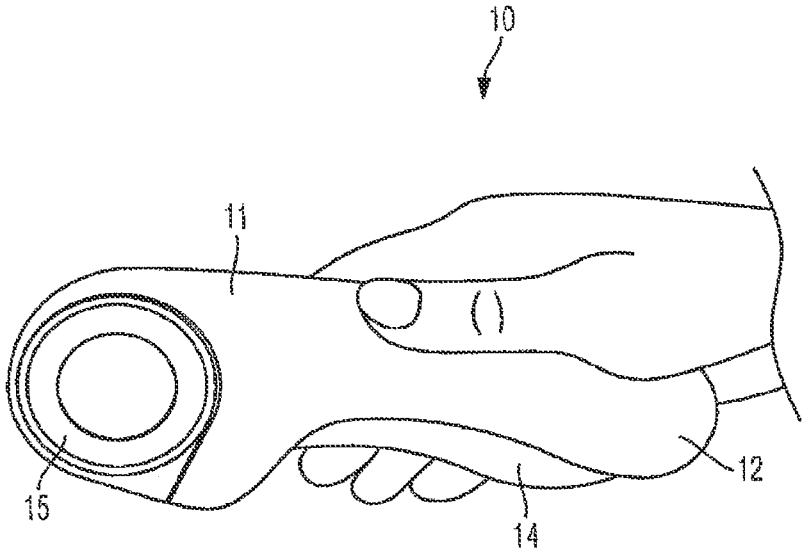
Fig. 2 PRIOR ART
Figure 3:
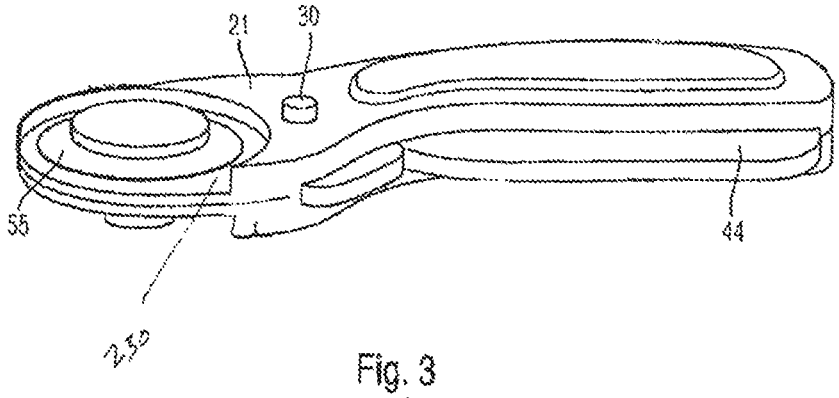
Fig. 3 PRIOR ART
FIGS. 3 to 5 are perspective views showing another example of a conventionally known cutter knife.
Figure 4:
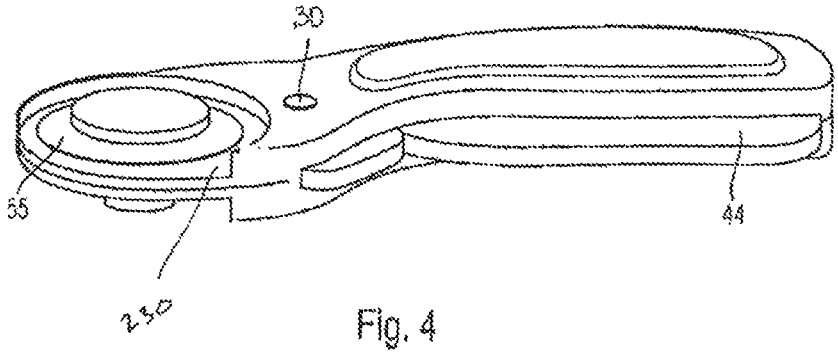
Fig. 4 PRIOR ART
Figure 5:
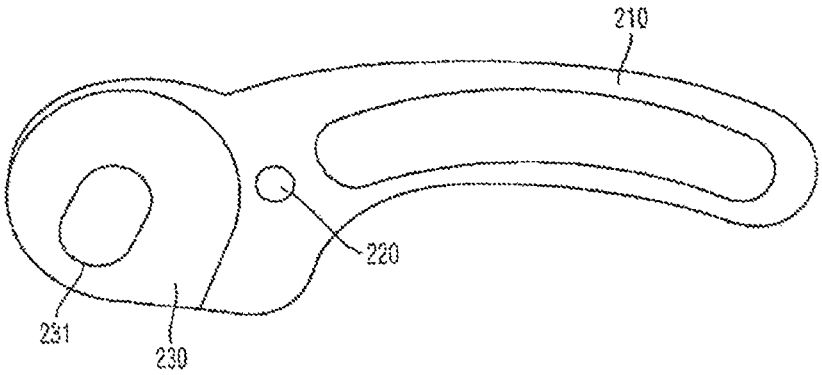
Fig. 5 PRIOR ART

The accompanying drawings are included to provide a further understanding of embodiments of the present invention. The drawings illustrate the embodiments and together with the description serve to explain principles of the present invention. Other embodiments and many of the intended advantages of the embodiments will be readily appreciated as they become better understood by reference to the following detailed description. The elements of the drawings are not necessarily scaled relative to each other. Similar reference numerals may be used to designate corresponding similar parts in distinct embodiments. Features of the various exemplary embodiments described herein may be readily combined with each other, unless specifically noted otherwise.

DETAILED DESCRIPTION OF THE EMBODIMENTS

Figure 6:
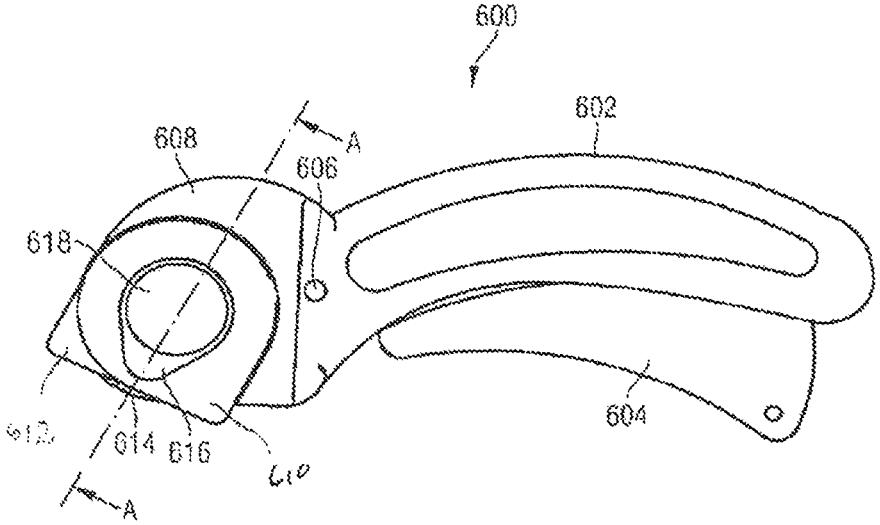
FIG. 6 is a front view showing the grip type cutter knife, in accordance with the present invention.

Referring now to the illustration of FIG. 6, FIG. 6 is a front view showing the grip type cutter knife, in accordance with the present invention.

The grip type cutter knife 600 of the present invention is shown in FIG. 6 as having an elongated cutter body 602 provided with a grip portion, having a trigger lever 604. A push type lock button 606 is provided on the grip type cutter knife. At the front end of the elongated cutter body 602 is provided a region 608 comprising a platform (not shown in the figure). As it may be further observed in FIG. 6, the grip type cutter knife 600 comprises a pair of flanges 610 and 612 and a cutting blade 614 disposed on the platform. The assembly of flange 610, cutting blade 614 and flange 612 are secured to the grip type cutter knife 600 via a closing plate 616 that may exhibit a logo 618. The grip type cutter knife 600 is illustrated in FIG. 6 in a rest position, while the trigger lever 604 is not gripped by a user and the cutting blade 614 and the cutting blade protector flanges 610 and 612 are in a non-cutting position, and the position of the push type lock button 606 is assumed to be in a locking position.

Figure 7:
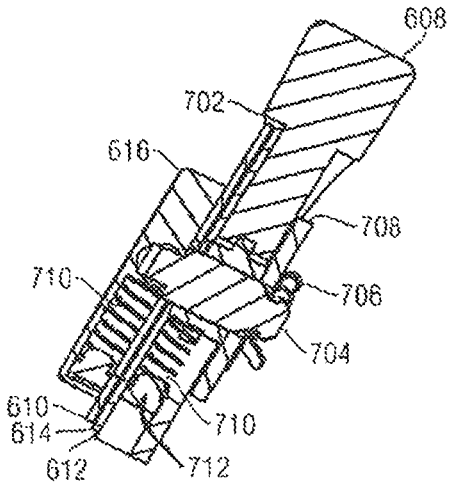
FIG. 7 is a sectional view of the grip type cutter knife of the present invention.

Referring now to the illustration of FIG. 7, FIG. 7 is a sectional view of the grip type cutter knife 600 of the present invention. The view of FIG. 7 may be obtained for example along the exemplary section line AA of FIG. 6.

As mentioned above and as it may be observed in FIG. 7, at the front end of the elongated cutter body 602 is provided a region 608 comprising a recessed region that forms a platform 702. The platform 702 comprises an elongated circular opening for allowing the cutting blade 614 and the cutting blade protector flanges 610 and 612 to slide outwards from the cutter knife body.

As it may be further observed in FIG. 7 an assembly formed by the cutter blade 614 and a pair of cutting blade protector flanges 610 and 612 is disposed on the platform 702. Each protector flange 610 and 612 is disposed on a side of the cutting blade 614, for example one protector flange 612 being disposed in the region comprised between the surface of platform 702 and the cutting blade 614, and the second protector flange 610 is disposed in the region between the cutting blade 614 and the closing plate 616.

A pin 704 is further provided in the grip type cutter knife 600, the pin 704 rotatably supporting the cutting blade 614 in the grip type cutter knife 600. The pin 704 has a first extremity of the pin being oriented from the cutting blade 614 towards the closing plate 616, and a second extremity being oriented from the cutting blade 614 towards the a back portion of the region 608, region not available for the viewer in the view of the invention illustrated in FIG. 6.

The pin 704 is secured via its second extremity to the back portion of the region 608 via a clip 706 and a washer 708. The first extremity of the pin is guided within the closing plate 616 that, as it will be shown later, comprises a sliding channel, the first extremity of the pin being able to slide along the channel of the closing plate 616.

The illustration of FIG. 7 further reveals that each cutting blade protector flange 610 and 612 disposed on each side of the cutting blade 614 exhibits an outward protrusion 712 from the surface of the flange, protrusion that may be exemplarily implemented via a screw head. A spring 710 extends from each protrusion 712 to the pin 704 on each cutting blade protector flange 610, the spring 710 being exemplarily united to the pin as well via a screw head. As illustrated in FIG. 7 each of said outward protrusion 712 supports a first extremity of each spring 710 and a second extremity of each of spring impinges upon said pin.

Figure 8:
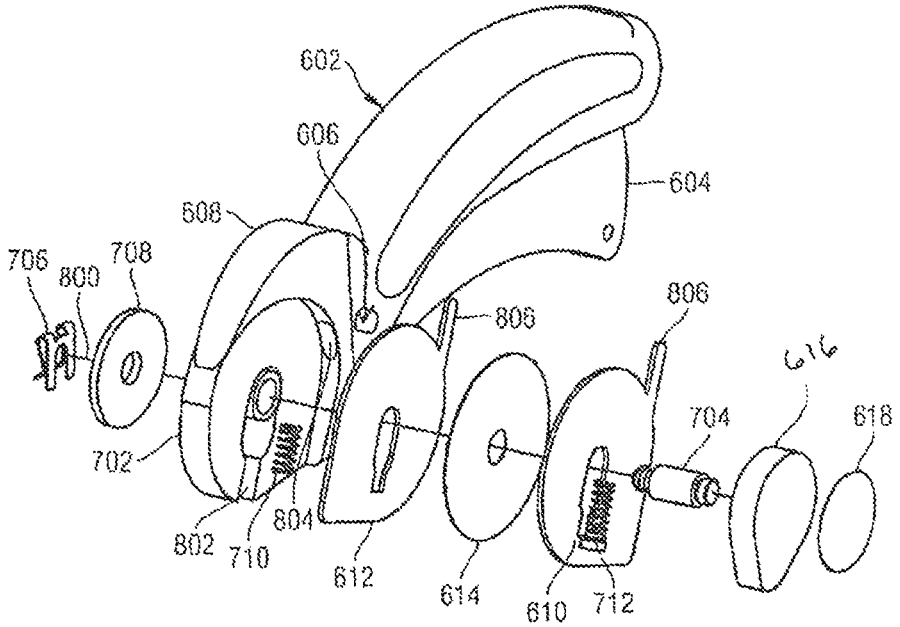
FIG. 8 is an exploded view of the grip type cutter knife of the present invention.

FIG. 8 is an exploded view of the grip type cutter knife 600 of the present invention.

The view of the present invention explained in connection with FIG. 8 will be assumed to range from the left side of the figure in the direction of the arrow towards the right side of the figure.

In accordance with the representation provided in FIG. 8 the grip type cutter knife 600 of the present invention comprises a clip 706 and a washer 708 that secure the second extremity of pin 704 to a region 608 of the elongated cutter body 602 of the grip type cutter knife 600. Although not illustrated in the figure the extremity of the pin 704 secured by the clip and washer assembly 706 and 708 is capable of translational upward downward movement in a direction perpendicular to the axis 800.

The front end of the elongated cutter body 602 is provided a region 608 comprising a platform 702. The platform 702 comprises an elongated circular opening for allowing the cutting blade 614 and the cutting blade protector flanges 610 and 612 to slide outwards from the cutter knife body. A through slot 802 of partially circular, elongated shape (not shown) is provided in the cutter knife body to allow the extremity of the pin to protrude through the region 608 of the elongated cutter body 602 of the grip type cutter knife 600. Further, the through slot 802 facilitates the translational upward downward movement in a direction perpendicular to the axis 800 of the pin through the body of platform 702.

The cutter knife body has a guiding cavity (not shown in the figure) with an opening 804 in towards the platform 702.

Directly in contact with the surface of the platform 702 is disposed a flange 612 that is represented in the figure as having an elongated central through slot and a guiding pin 806 protruding outward from the perimeter of the flange. The outer perimeter of the flange is circular, with a flat bottom portion in the vicinity of the flange that comes in contact with a material to be cut, and a flat vertical portion in a portion of the flange extending away from the flat bottom portion, the flat bottom portion and the flat vertical portion of the flange forming a 90 degrees angle. The flange 612 is represented with the portion shaped to firm 90 degrees between its two sections oriented towards the viewer.

The guiding pin 806 is extending out from the perimeter of the flange into the guiding cavity 804, for guiding a translational movement of the flange 612 along a longitudinal axis of the spring 710.

A cutting blade 614 is disposed between two subsequent flanges, the blade being circular and having a radius that is slightly smaller than the radius of the flanges 612 and 610. Further, the circular blade 614 has a circular slot that affixes the cutting blade to the pin 704. The second flange 610 is placed in the view of FIG. 8 after the cutting blade 614, with the portion shaped to form 90 degrees between its two sections oriented away from the viewer. Both flanges 610 and 614 have an outward protrusion 712 from the surface of the flange, protrusion that may be exemplarily implemented via a screw head. A spring 710 extends from each protrusion 712 to the pin 704 on each cutting blade protector flange 610 and 614, the spring 710 being exemplarily united to the pin as well via a screw head. As illustrated in FIG. 7 each of said outward protrusion 712 supports a first extremity of each spring 710 and a second extremity of each of spring impinges upon said pin.

A pin 704 is as well represented in FIG. 8. The person skilled in the art, viewing the representation of FIG. 8 would be aware that this representation is not to scale and the pin's dimensions are not truly represented in FIG. 8. The pin 704 is longer and as discussed in detail above, extends from the clip 706 to the closing plate 616. The closing plate 616 has a sliding channel (not shown in the figure), and a first extremity of pin 704 is capable of executing a translational sliding motion in the channel.

Prior to being in use the grip type cutter knife 600 of the present invention may be stored in a rest position that entails at least that trigger lever 604 protrudes from the handle of the knife and is arrested in this position via the push type lock button 606. In this position the cutting blade—flange assembly is as well in the rest position, on the platform 702 that comprises the elongated circular opening for allowing the cutting blade 614 and the cutting blade protector flanges 610 and 612 to slide outwards from the cutter knife body. No further details will be provided in this document regarding the mechanism involved in arresting the trigger lever 604 in the rest or locked position, since said details are known to the person skilled in the art. Due to the pressure exerted by the springs the flanges are resting in a position that completely covers the blade. As described above, the two flanges are not symmetrical.

The grip type cutter knife 600 of the present invention may be used by a user by gripping the handle 602, releasing the push type lock button 606 and pressing the trigger lever 604. Alternatively, the user may, via the push lock button 606, maintain the trigger lever inside the handle. In either case, the cutting wheel—flange assembly will be released into an "unlocking position", and it will be lowered from the rest position to a cutting position. During the cutting operation of a material a drawing force is applied to the handle to move the cutting wheel—flange assembly on the material to be cat along the intended line of cutting while the handle is concurrently downwardly pressed by the application of a slight pressing force to the handle. As a result the flanges are brought in contact with the surface of the material to be cut that is presumably resting on a resilient surface. Due to the downward pressing force the springs associated with the flanges are inwardly compressed. Upon the application of further pressing force that is equal or larger than the resistance generated by the compressed springs the blade that has smaller radius than the flanges, will come in contact with the material to be cut. While descending from a locked position into the unlocking position, the cutting wheel flange assembly is guided along a predetermined descent direction by the guiding pins 806 that are lowered in the channel 804. Should an obstacle appear along the cutting line, either in front of the grip type cutter knife and after the grip type cutter knife, the obstacle will come in contact first with either one of the pair of flanges 610 and 612 and will prevent the cutting blade 614 to come in contact with the obstacle. Should the obstacle be the finger of the operator, as it often occurs due to the unsafe operation of the knife by the operator, the fingers are protected from coming in contact with the cutting blade 614 since the operator's finger comes first in contact with the edge of either one of flanges 610 or 612. As such, the present invention provides for the safe operation of the grip type cutter knife.

Alternatively to the above, since the two cutting blade protector flanges operate independently from each other, dependent on the direction of primary motion a flange may mask the blade while the other flange releases the blade.

Although the present invention has fully been described by way of the preferred embodiments thereof, it is to be noted that various changes and modifications are apparent to those skilled in the art. Accordingly, unless such changes and modifications depart from the true scope of the present invention, they should be construed as included therein.

What is claimed is:

1. A grip type cutter knife, comprising:

a cutter knife body having a grip portion, wherein the grip portion comprises a trigger lever, a cutting blade provided on an end of the cutter knife body, a pin rotatably supporting the cutting blade in the cutter knife body, a locking member placed in an opening formed in the cutter knife body, a pair of cutting blade protector flanges, each protector flange being disposed on a side of the cutting blade, wherein each of said pair of cutting blade protector flanges has an outward protrusion from a surface of the flange, and a pair of springs located between the pin and each of the outward protrusions from the flange surface, wherein each spring of said pair of springs is located between the pin and one of the outward protrusions, wherein the pair of cutting blade protector flanges is slidably supported in the cutter knife body by the pin and the pair of springs, and wherein a circumference of each of said pair of cutting blade protector flanges comprises a circular portion and a flat bottom portion for contact with a material to be cut, the flat bottom portion coextensive with the circular portion and extending in a direction perpendicular to a rotational axis of the cutting blade.

2. The grip type cutter knife according to claim 1, wherein the cutter knife body comprises a platform, and wherein the cutting blade and the pair of cutting blade protector flanges are disposed on said platform.

3. The grip type cutter knife according to claim 2, wherein said platform comprises an elongated circular opening for allowing the cutting blade and the cutting blade protector flanges to slide outwards from the cutter knife body.

4. The grip type cutter knife according to claim 1, wherein each of said outward protrusions supports a first extremity of each of said pair of springs.

5. The grip type cutter knife according to claim 1, wherein a second extremity of each of said pair of springs impinges upon said pin.

6. The grip cutter knife according to claim 1, wherein the cutter knife body has a guiding cavity with an opening towards said platform, wherein each of said pair of cutting blade protector flanges has a guiding pin extending out in said cavity, and wherein each of the guiding pins of the cutting blade protector flanges is capable of translational movement within said guiding cavity.

7. The grip knife according to claim 1, further comprising: a closing plate having a sliding channel, wherein a first extremity of said pin is capable of executing a translational sliding motion in said sliding channel.

8. The grip knife according to claim 1, further comprising a clip and washer assembly to secure to the grip knife a second extremity of said pin.

9. The grip knife according to claim 1, wherein a circumference of the cutting blade is smaller than the circumference of each cutting blade protector flange.

10. The grip knife according to claim 1, wherein the circumference of each of said flanges further comprising a flat vertical portion which extends perpendicular to the flat bottom portion.

11. The grip knife according to claim 1, wherein the pair of cutting blade protector flanges are asymmetrical.

12. A grip type cutter knife, comprising:

a cutter knife body having a grip portion, wherein the grip portion comprises a trigger lever, a cutting blade provided on an end of the cutter knife body, a pin rotatably supporting the cutting blade in the cutter knife body, a locking member placed in an opening formed in the cutter knife body, a pair of cutting blade protector flanges, each protector flange being disposed on a side of the cutting blade, wherein each of said pair of cutting blade protector flanges has an outward protrusion from a surface of the flange, and a pair of springs located between the pin and each of the outward protrusions from the flange surface, wherein each spring of said pair of springs is located between the pin and one of the outward protrusions, wherein the pair of flanges is slidably supported in the cutter knife body by the pin and the pair of springs, and wherein an outer perimeter of each of the pair of cutting blade protecting flanges comprises a flat bottom portion extending in a direction perpendicular to a rotational axis of the cutting blade for contact with a material to be cut and a flat vertical portion extending away from the flat bottom portion, such that the flat bottom portion and the flat vertical portion of each flange form an 90 degree angle.

13. The grip knife according to claim 12, wherein the pair of cutting blade protector flanges are asymmetrical.

14. A grip type cutter knife, comprising:

a cutter knife body having a grip portion, wherein the grip portion comprises a trigger lever, a cutting blade provided on an end of the cutter knife body, a pin rotatably supporting the cutting blade in the cutter knife body, a locking member placed in an opening formed in the cutter knife body, a pair of cutting blade protector flanges, each protector flange being disposed on a side of the cutting blade, wherein each of said pair of cutting blade protector flanges has an outward protrusion from a surface of the flange, and a pair of springs located between the pin and each of the outward protrusions from the flange surface, wherein the pair of flanges is slidably supported in the cutter knife body by the pin and the pair of springs, wherein each spring of said pair of springs is located between the pin and one of the outward protrusions, and wherein a circumference of each of the pair of cutting blade protecting flanges has a protruding square edge region such that the cutting blade protector flanges intervene between the cutting blade and an obstacle that may be encountered between the cutting blade protector flanges and the cutting blade, wherein the protruding square edge region of each of the pair of cutting blade protecting flanges comprises a flat bottom portion extending in a direction perpendicular to a rotational of the cutting blade for contact with a material to be cut and a flat vertical portion extending away from the flat bottom portion, such that the flat bottom portion and the flat vertical portion of each flange form a 90 degree angle.

15. The grip knife according to claim 14, wherein the pair of cutting blade protector flanges are asymmetrical.

* * * * *